US012414672B1

(12) United States Patent
Wood

(10) Patent No.: US 12,414,672 B1
(45) Date of Patent: Sep. 16, 2025

(54) COMPACT DRYING RACK

(71) Applicant: Zak Wood, Sammamish, WA (US)

(72) Inventor: Zak Wood, Sammamish, WA (US)

( * ) Notice: Subject to any disclaimer, the term of this patent is extended or adjusted under 35 U.S.C. 154(b) by 0 days.

(21) Appl. No.: 18/793,857

(22) Filed: Aug. 4, 2024

(51) Int. Cl.
*A47L 19/04* (2006.01)
*A47B 81/04* (2006.01)
*A47F 7/28* (2006.01)

(52) U.S. Cl.
CPC ..... *A47L 19/04* (2013.01); *A47B 81/04* (2013.01); *A47F 7/28* (2013.01)

(58) Field of Classification Search
CPC ..... A47L 19/00; A47L 19/02; A47L 19/04; A47B 73/008; A47B 81/04; A47F 7/28
USPC ..... 211/41.3, 41.6
See application file for complete search history.

(56) References Cited

U.S. PATENT DOCUMENTS 499,951 A * 6/1893 Baird ..... A47L 19/04 220/572
946,977 A * 1/1910 Muller ..... A47L 19/04 294/142
1,176,697 A * 3/1916 Blakeslee ..... A47L 19/04 211/41.4
1,341,717 A * 6/1920 Lynch ..... A47L 19/04 211/41.3
1,350,351 A * 8/1920 Abbott ..... A47L 19/04 211/41.4
1,714,629 A * 5/1929 Rodin ..... A47L 19/04 211/41.6
1,733,907 A * 10/1929 Scheuermann ..... A47L 19/00 211/41.3
1,789,232 A * 1/1931 Hertz ..... A47L 19/04 211/41.3
1,810,855 A * 6/1931 Rockmore ..... A47L 19/04 220/629
2,655,267 A * 10/1953 Planeta ..... A47L 19/04 211/74
2,708,037 A * 5/1955 Planeta ..... A47L 19/04 211/74
3,442,395 A * 5/1969 Taylor ..... A47L 19/04 D32/55
4,169,638 A * 10/1979 Cirasuolo ..... A47L 19/04 211/41.6
4,238,035 A 12/1980 Kassanchuck
5,012,934 A * 5/1991 Newhall ..... A47L 19/00 D32/55
D322,343 S 12/1991 Pearcy
5,109,990 A * 5/1992 Murphy ..... A47J 47/20 211/41.3
5,492,237 A * 2/1996 Chang ..... A47L 19/04 211/202

(Continued)

FOREIGN PATENT DOCUMENTS

CH 203391 A * 3/1939
FR 2368928 A1 * 5/1978

(Continued)

*Primary Examiner* — Stanton L Krycinski

(57) ABSTRACT

A compact drying rack has a rectangular base section and an upright support section removably connected to the rectangular base section. The upright support section includes a front support arch and a rear support arch slidably interconnected by a double tongue and groove connection. The upright support section is connected to the base section by cantilever snap-fit connectors.

12 Claims, 12 Drawing Sheets

(56) References Cited

U.S. PATENT DOCUMENTS

| | | | | | |
|---|---|---|---|---|---|
| 5,901,861 | A * | 5/1999 | Huguet | A47L 19/04 | 211/85.15 |
| D416,119 | S * | 11/1999 | Newhall | D32/55 | |
| 6,038,784 | A * | 3/2000 | Dunn | F26B 25/18 | 211/41.6 |
| 6,062,397 | A * | 5/2000 | Licari | A47J 47/20 | D32/55 |
| 7,669,721 | B2 * | 3/2010 | Kemper | A47L 19/04 | 211/41.3 |
| D634,909 | S * | 3/2011 | Guthrie | D32/55 | |
| 8,960,452 | B2 * | 2/2015 | Rhodes, II | A47L 19/04 | 211/41.6 |
| 10,052,012 | B2 * | 8/2018 | Mesa | A47L 15/50 | |
| 10,631,711 | B2 | 4/2020 | Dunn et al. | | |
| D916,412 | S | 4/2021 | Moody Fear et al. | | |
| D970,843 | S | 11/2022 | Mao | | |
| 11,717,135 | B1 * | 8/2023 | Wood | A47L 19/00 | 211/41.6 |
| 2007/0090063 | A1 * | 4/2007 | Schmidt | A47L 19/04 | 211/41.3 |
| 2008/0185352 | A1 * | 8/2008 | O'Hara | A47L 19/02 | 211/13.1 |
| 2012/0138550 | A1 * | 6/2012 | Wisniewski | A47L 19/04 | 211/41.3 |
| 2014/0197121 | A1 * | 7/2014 | Knight | A47B 88/988 | 29/428 |
| 2017/0215691 | A1 * | 8/2017 | Henry | A47B 81/04 | |

FOREIGN PATENT DOCUMENTS

| | | | |
|---|---|---|---|
| GB | 191512089 | A * | 2/1916 |
| GB | 217399 | A * | 6/1924 |
| GB | 225430 | A * | 12/1924 |
| GB | 446807 | A * | 5/1936 |
| KR | 20070062656 | A * | 6/2007 |

* cited by examiner

COMPACT DRYING RACK

RELATED APPLICATIONS

This is the first application filed for this invention.

FIELD OF THE INVENTION

This invention relates in general to racks for drying bottles, glasses, cups, and small kitchen items, and, in particular to a novel compact dying rack that may be disassembled for shipping and storage.

FIELD OF THE INVENTION

Although it is desirable to eliminate single-use plastic from the environment no practical replacements have yet been invented that are suitable to replace certain plastic products. The plastic water bottle is one such product.

Approximately 50 billion plastic water bottles are sold every year in the United States alone. Of those at most about 12% are recycled. The remainder end up in landfills or incinerators. It is therefore important to find a way of recycling more plastic water bottles.

Racks for drying items that should be hand-washed such as plastic bags, silicone bags, vacuum insulated stainless steel cups and tumblers, certain plastic cups, drinking glasses, bottles, and other kitchenware, are well known and commercially available in a variety of shapes, sizes, and configurations. While many drying rack configurations have been invented, few are capable of being folded or disassembled for easy shipping or storage.

There therefore exists a need for a compact drying rack made of recycled plastic water bottles capable of being disassembled for convenient shipping or storage.

SUMMARY OF THE INVENTION

It is an object of the invention to provide a compact drying rack made of recycled plastic water bottles that may be disassembled for shipping and storage when not in use.

The invention therefore provides a compact drying rack comprising: a substantially rectangular base section having a base perimeter top flange with a depending base perimeter outer skirt, a base perimeter inner skirt and a plurality of spaced-apart parallel base slats integral with the base perimeter inner skirt; first and second front leg members and first and second rear leg members that support the rectangular base section above a support surface; an upright support section removably connected to the rectangular base section, the upright support section including a front support arch having a plurality of vertical support posts and a rear support arch having a plurality of vertical support posts, the front support arch being removably connected to the rear support arch by a connection that inhibits movement of the front support arch with respect to the rear support arch when the upright support section is connected to the rectangular base section.

The invention further provides a compact drying rack comprising: a substantially rectangular base section having a base perimeter top flange with a depending base perimeter outer skirt, a base perimeter inner skirt and a plurality of spaced-apart parallel base slats integral with the base perimeter inner skirt, the base perimeter top flange including front base receptacles and rear base receptacles adjacent a rear edge of the rectangular base section; first and second front leg members and first and second rear leg members that support the rectangular base section above a support surface; an upright support section removably connected to the rectangular base section by cantilever snap-fit connectors having front arch protrusions received in the front base receptacles and rear arch protrusions received in the rear base receptacles, the upright support section including a front support arch having a plurality of spaced-apart vertical support posts and a rear support arch having a plurality of spaced-apart vertical support posts, the front support arch being removably connected to the rear support arch by sliding engagement of a double tongue and groove connection that inhibits movement of the front support arch with respect to the rear support arch when the upright support section is connected to the rectangular base section by the cantilever snap-fit connectors; the double tongue and groove connection including a rear arch interlock tongue slidably received in a front arch interlock groove, the rear arch interlock tongue providing a rear arch interlock groove that slidably receives a front arch interlock tongue.

BRIEF DESCRIPTION OF THE DRAWINGS

Having thus generally described the nature of the invention, reference will now be made to the accompanying drawings, in which.

DETAILED DESCRIPTION OF THE PREFERRED EMBODIMENTS

The invention provides a compact drying rack made of recycled plastic. The compact drying rack disassembles for shipping and compact storage. The compact drying rack has a base section with integral legs that elevate the base section from a supporting surface to promote air circulation and rapid drying. The compact drying rack further includes two support arches. Each support arch has a plurality of integral support posts on a top surface thereof for supporting inverted bottles, cups, glasses, bags, and the like to promote draining and drying. Legs of the two support arches are respectively provided with cantilever snap fit joints and section interlocks that lock the support arches together and to the rack base in an assembled condition to ensure that the support arches are rigid and stable in the assembled condition, and suitable for bearing a load on each of the plurality of support posts. In one embodiment, all components of the compact drying rack are manufactured from the recycled plastic of approximately 75 plastic water bottles, facilitating the recycling of that plastic and diverting it from landfill.

PARTS LIST

| | |
|---|---|
| 10 | Compact drying rack |
| 12 | Base section |
| 14 | Upright support section |
| 16 | Front support arch |
| 17R | Front arch right leg |
| 17L | Front arch left leg |
| 18 | Rear support arch |
| 19R | Rear arch right leg |
| 19L | Rear arch left leg |
| 20 | Support posts |
| 21 | Base perimeter top flange |
| 22 | Base perimeter outer skirt |
| 23 | Base perimeter inner skirt |
| 24 | Front leg members |
| 26 | Rear leg members |
| 28 | Base slats |
| 30 | Front leg feet |
| 32 | Rear leg feet |
| 34 | Front arch lock tab |
| 36 | Rear arch lock tab |
| 38R | Front arch interlock-right side |
| 38L | Front arch interlock-left side |
| 40R | Rear arch interlock-right side |
| 40L | Rear arch interlock-left side |
| 42 | Front arch interlock groove |
| 44 | Front arch interlock tongue |
| 46 | Rear arch interlock groove |
| 48 | Rear arch interlock tongue |
| 50 | Front base receptacles |
| 52 | Rear base receptacles |
| 54 | Front arch protrusions |
| 56 | Rear arch protrusions |
| 58 | Front arch interlock reinforcement web |
| 58N | Front arch interlock reinforcement web groove |
| 60 | Rear arch interlock reinforcement web |
| 62 | Base skirt connector |

Figure 1:
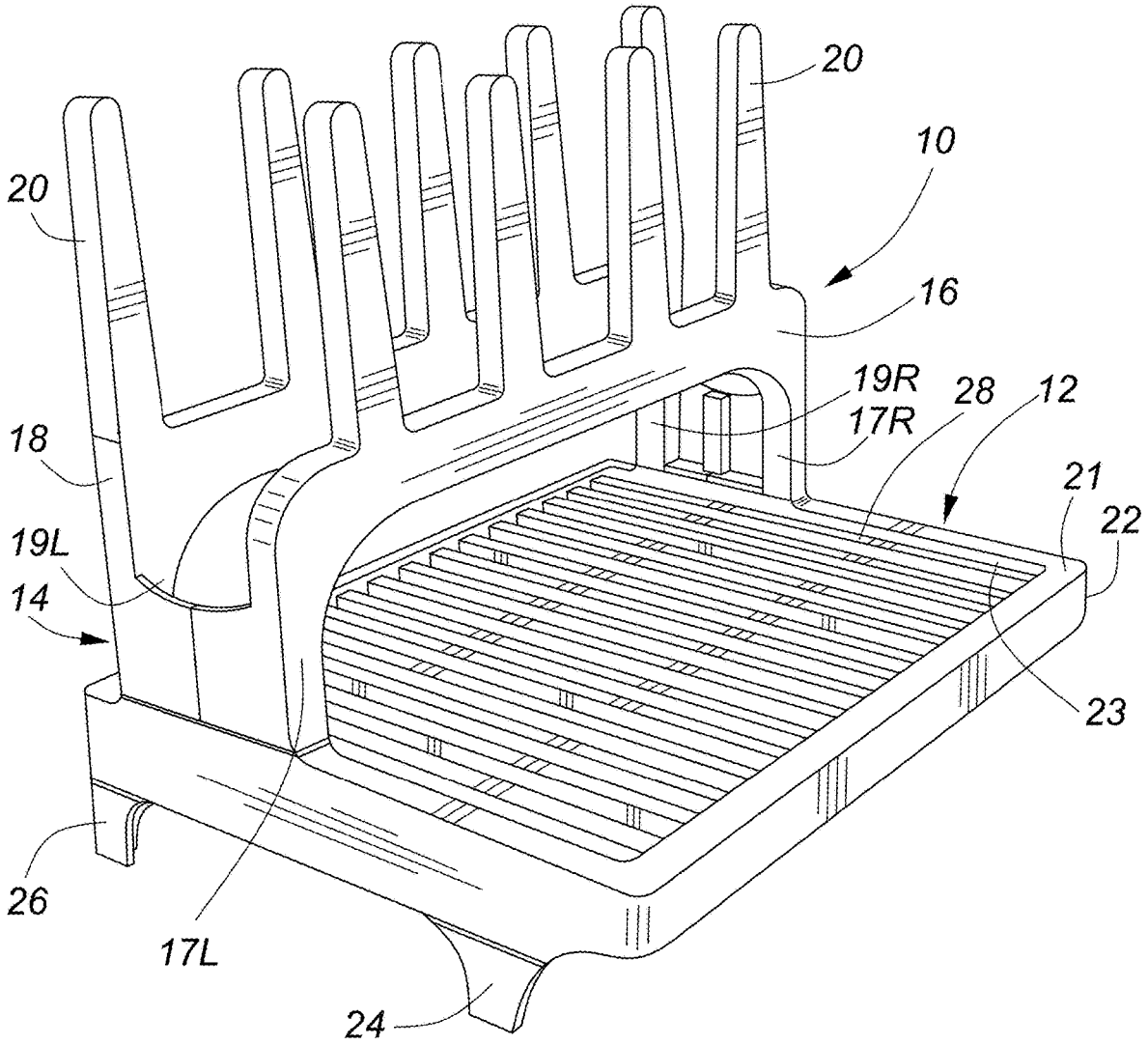
FIG. 1 is a perspective view of a compact drying rack in accordance with the invention, shown in an assembled condition.

FIG. 1 is a perspective view of the compact drying rack 10 in accordance with the invention, shown in an assembled condition. The compact drying rack 10 includes a rectangular base section 12 and a two-part upright support section 14 detachably connected to the base section 12 adjacent a rear edge of the rectangular base section 12. The upright support section 14 includes a front support arch 16 and a rear support arch 18. Each support arch 16, 18 has a plurality of integral spaced-apart vertical support posts 20 in a plane of the respective arches for supporting bottles, cups, glasses, bags, etc. in an inverted condition. The front support arch 16 is supported on the base section 12 by front arch right leg 17R and front arch left leg 17L. The rear support arch 18 is supported on the base section 12 by rear arch right leg 19R and rear arch left leg 19L. The rectangular base section 12 has a base perimeter top flange 21 with a depending base perimeter outer skirt 22 and a base perimeter inner skirt 23. The base perimeter outer skirt 22 is wider on each side of the base section 12 and includes integral front leg members 24 and rear leg members 26 that, in one embodiment, wrap around each rear corner of the base section 12. The base perimeter inner skirt 23 supports a plurality of integral spaced-apart inverted U-shaped parallel base slats 28 for supporting washed items to be air-dried.

Figure 2:
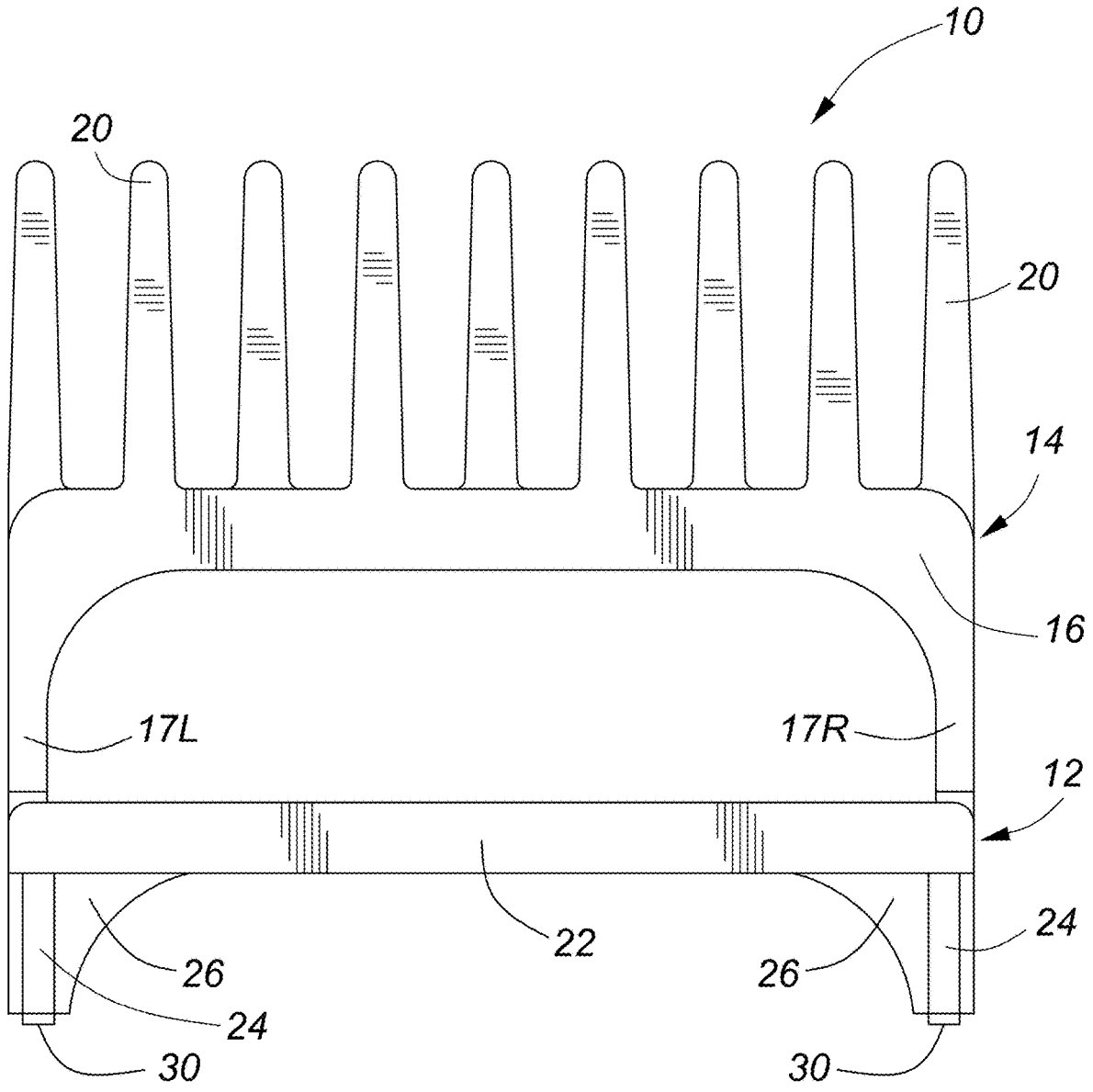
FIG. 2 is a front elevational view of the compact drying rack in the assembled condition.

FIG. 2 is a front elevational view of the compact drying rack 10. As can be seen, the front leg members 24 are each provided with a front leg foot 30. In one embodiment the front leg feet 30 are made of a non-slip material to inhibit the drying rack 10 from sliding on a smooth surface.

Figure 3:
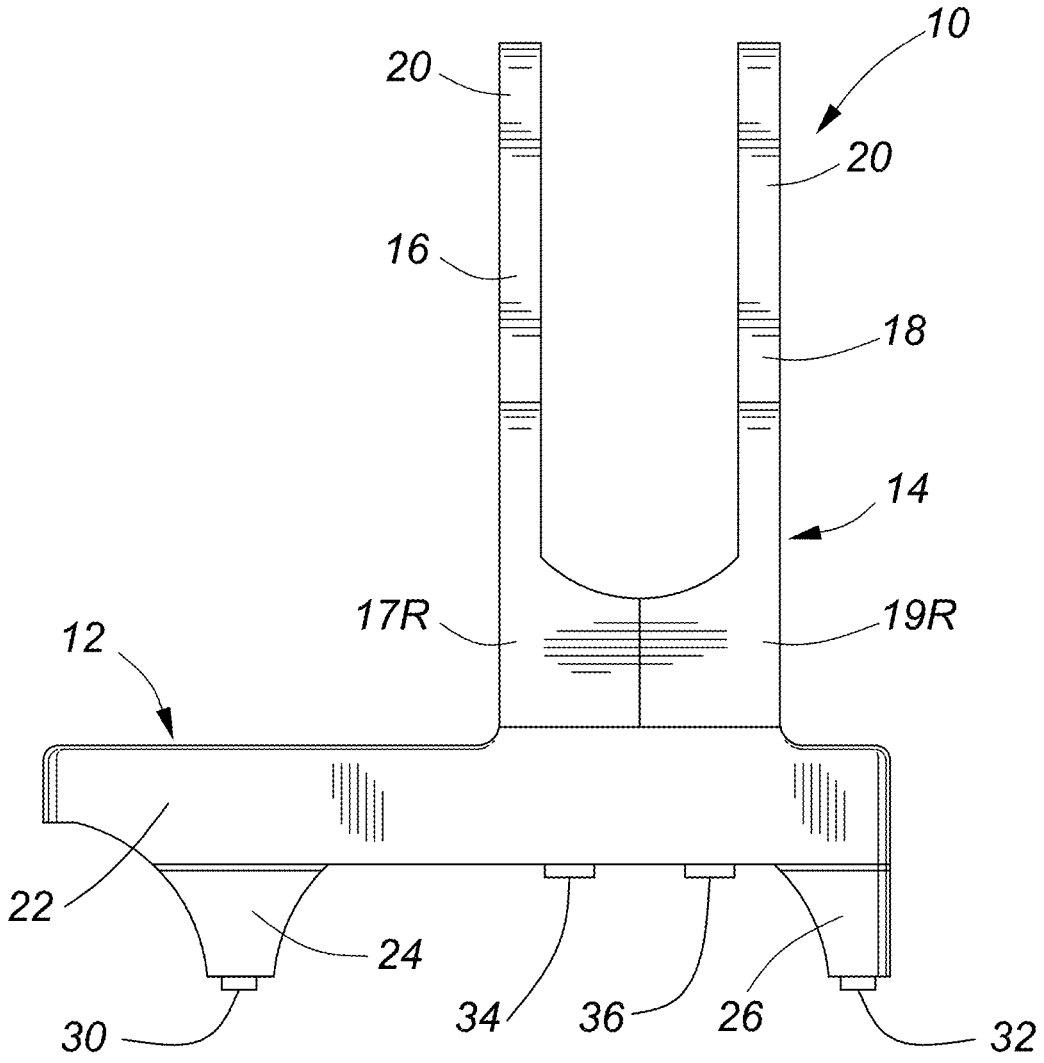
FIG. 3 is a right side elevational view of the compact drying rack in the assembled condition.

FIG. 3 is a right side elevational view of the compact drying rack 10. The rear leg members 26 are each provided with a rear leg foot 32. In one embodiment the rear leg feet 32 are made of a non-slip material to inhibit the drying rack 10 from sliding on a smooth surface. The front arch right leg 17R is provided with a cantilever snap-fit connector having a front arch lock tab 34 that removably locks the front support arch 16 to the base section 12, as will be explained below in more detail. The rear arch right leg 19R is provided with a cantilever snap-fit connector having a rear arch lock tab 36 that removably locks the rear support arch 18 to the base section 12, as will also be explained below in more detail.

Figure 4:
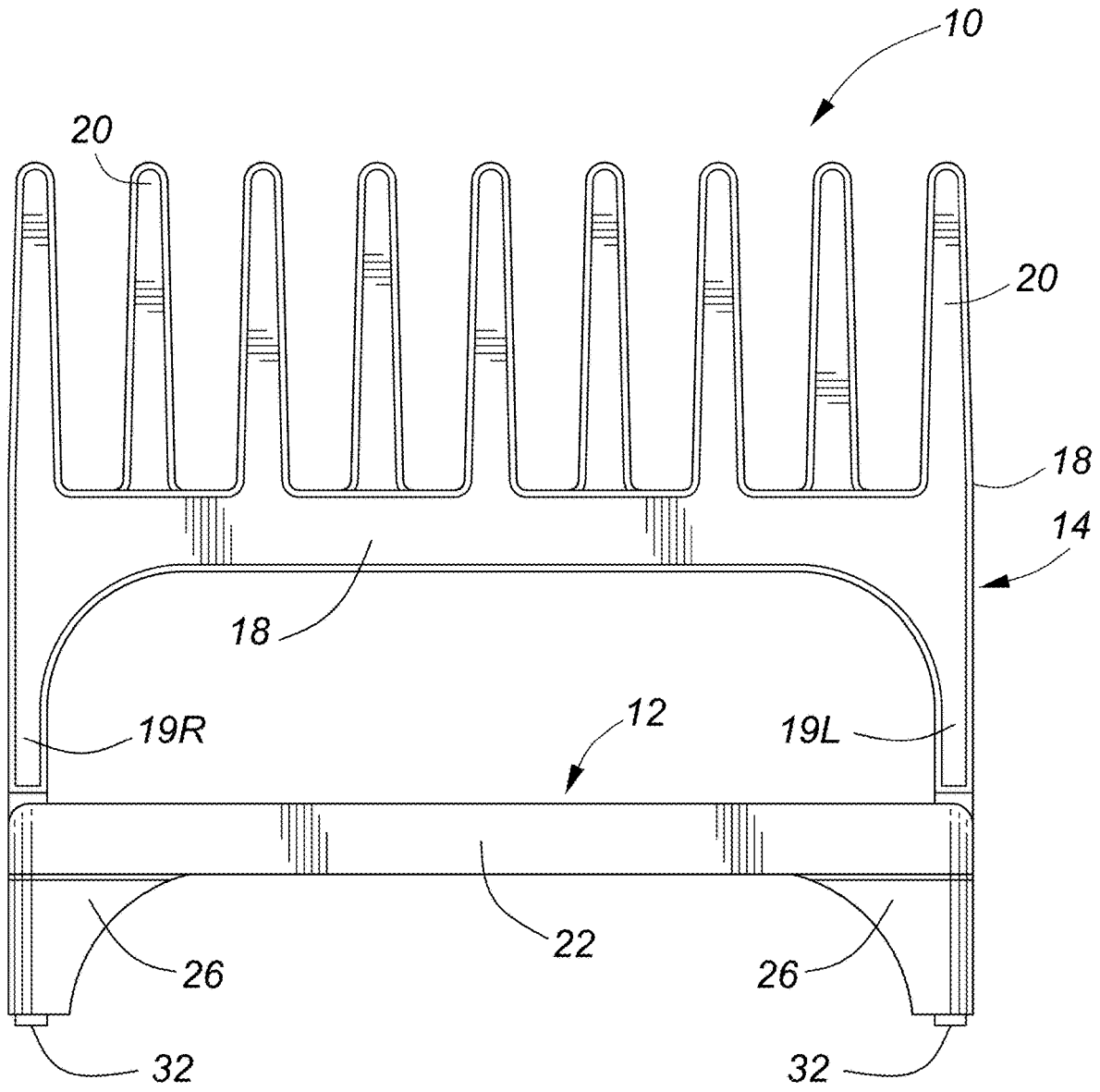
FIG. 4 is a rear elevational view of the compact drying rack in the assembled condition.

FIG. 4 is a rear elevational view of the compact drying rack 10 showing the rear leg members 26 wrapped around the rear side of the base section 12 and the rear leg feet 32.

Figure 5:
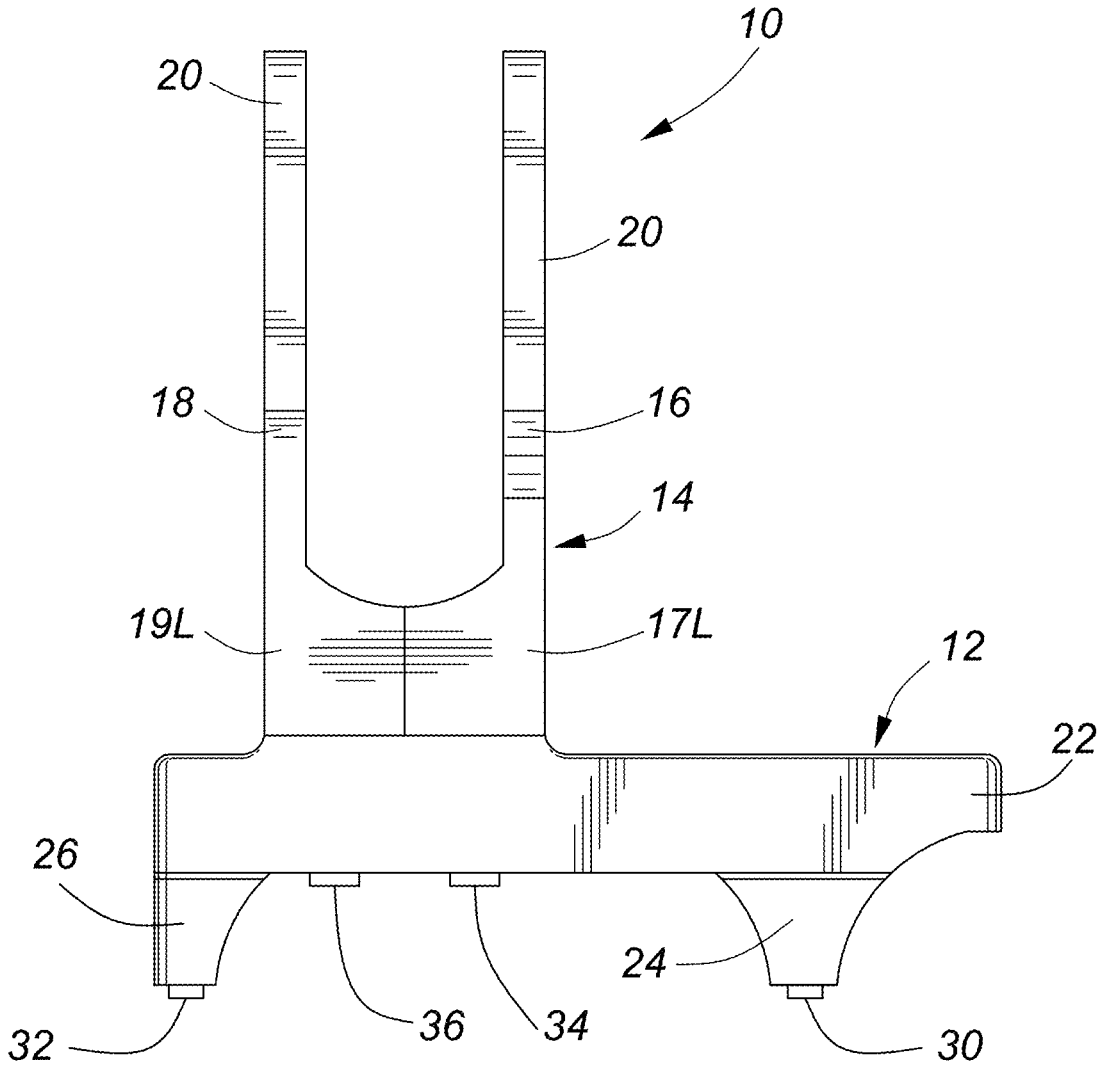
FIG. 5 is a left side elevational view of the compact drying rack in the assembled condition.

FIG. 5 is a left side elevational view of the compact drying rack 10 showing the front arch lock tab 34 of the cantilever snap-fit connector that removably locks the front arch left leg 17L to the rectangular base section 12, and the rear arch lock tab 36 of the cantilever snap-fit connector that removably locks the rear arch left leg 19L to the rectangular base section 12.

Figure 6:
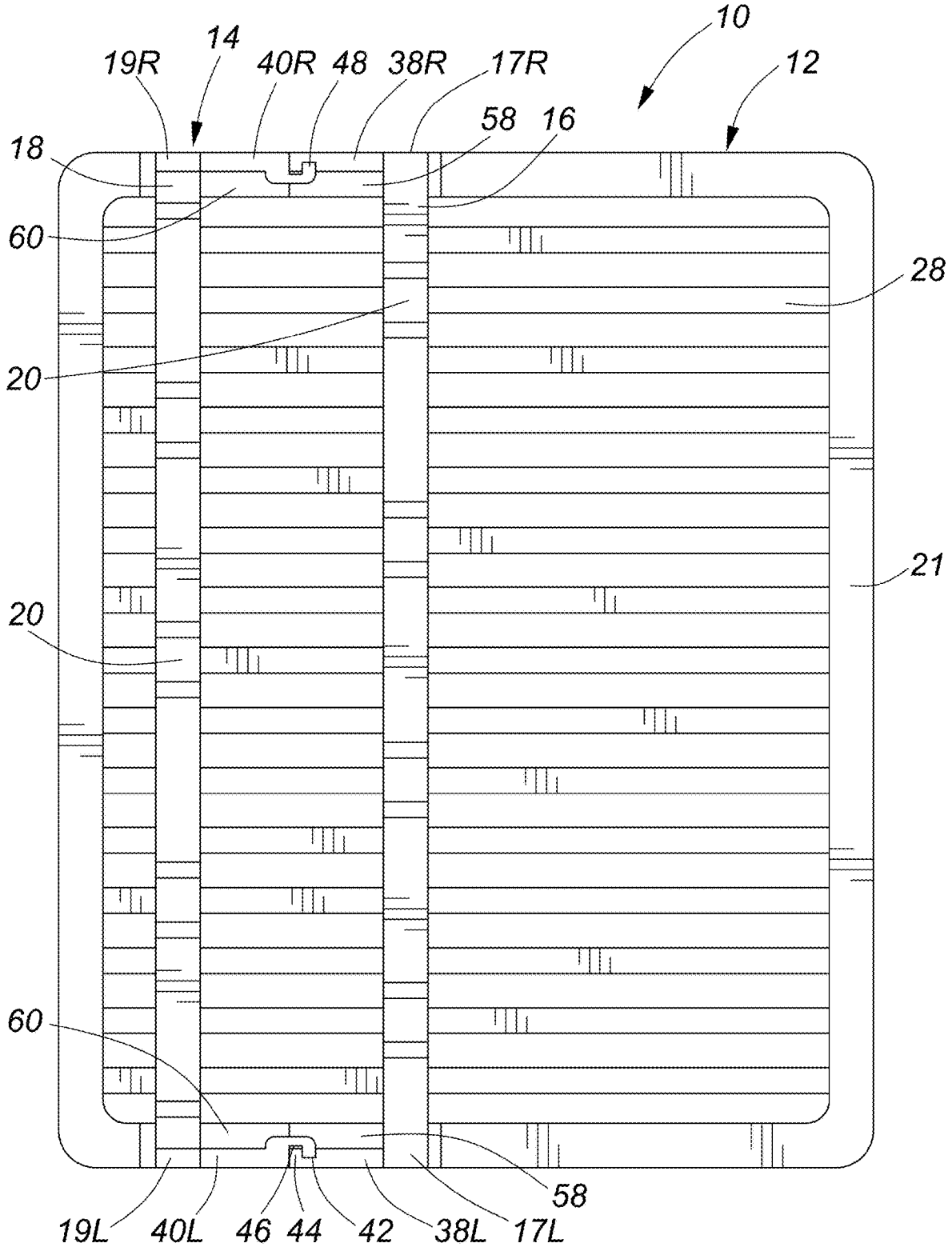
FIG. 6 is a top plan view of the compact drying rack in the assembled condition.

FIG. 6 is a top plan view of the compact drying rack 10. In addition to cantilever snap-fit connectors that removably lock the front support arch 16 and the rear support arch 18 to the rectangular base section 12, the front support arch 16 and the rear support arch 18 are further provided with front arch interlocks 38R, 38L that are respectively removably and slidably engaged by corresponding rear arch interlocks 40R, 40L in a double tongue and groove joint that resists tension, bending, shear, and torsional forces induced on the front support arch 16 and the rear support arch 18 by loads placed on the support posts 20. The double tongue and groove joint consists of a front arch interlock groove 42 and a front arch interlock tongue 44 adjacent the front arch interlock groove 42. The front arch interlock groove 42 slidably accepts a rear arch interlock tongue 48 that wraps around the front arch interlock tongue 44 to create a rear arch interlock groove 46 that accepts the front arch interlock tongue 44. The front arch interlocks 38R, 38L are reinforced by a rectangular front arch interlock reinforcement web 58 that is integral with a bottom edge of the respective front arch interlock 38R and front arch interlock 38L. The rear arch interlocks 40R, 40L are reinforced by a rectangular rear arch interlock reinforcement web 60 that is integral with a bottom edge of the respective rear arch interlock 40R and the rear arch interlock 40L. The respective front arch interlock reinforcement web 58 and the rear arch interlock reinforcement web 60 abut on their fee ends and lie flat on a top surface of the base section 12 to increase a footprint of the front support arch 16 and the rear support arch 18 and thus improve strength and stability of the assembled upright support section 14. The front arch interlock reinforcement web 58 has a front arch interlock reinforcement web groove 58N (see FIG. 11) that accepts a bottom end of the rear arch interlock tongue 48 to inhibit unintentional disengagement of the rear arch interlock tongue 48 from the front arch interlock groove 46. In the assembled condition, the rear arch interlock tongue 48 rests on a top surface of the rectangular base section 12.

Figure 7:
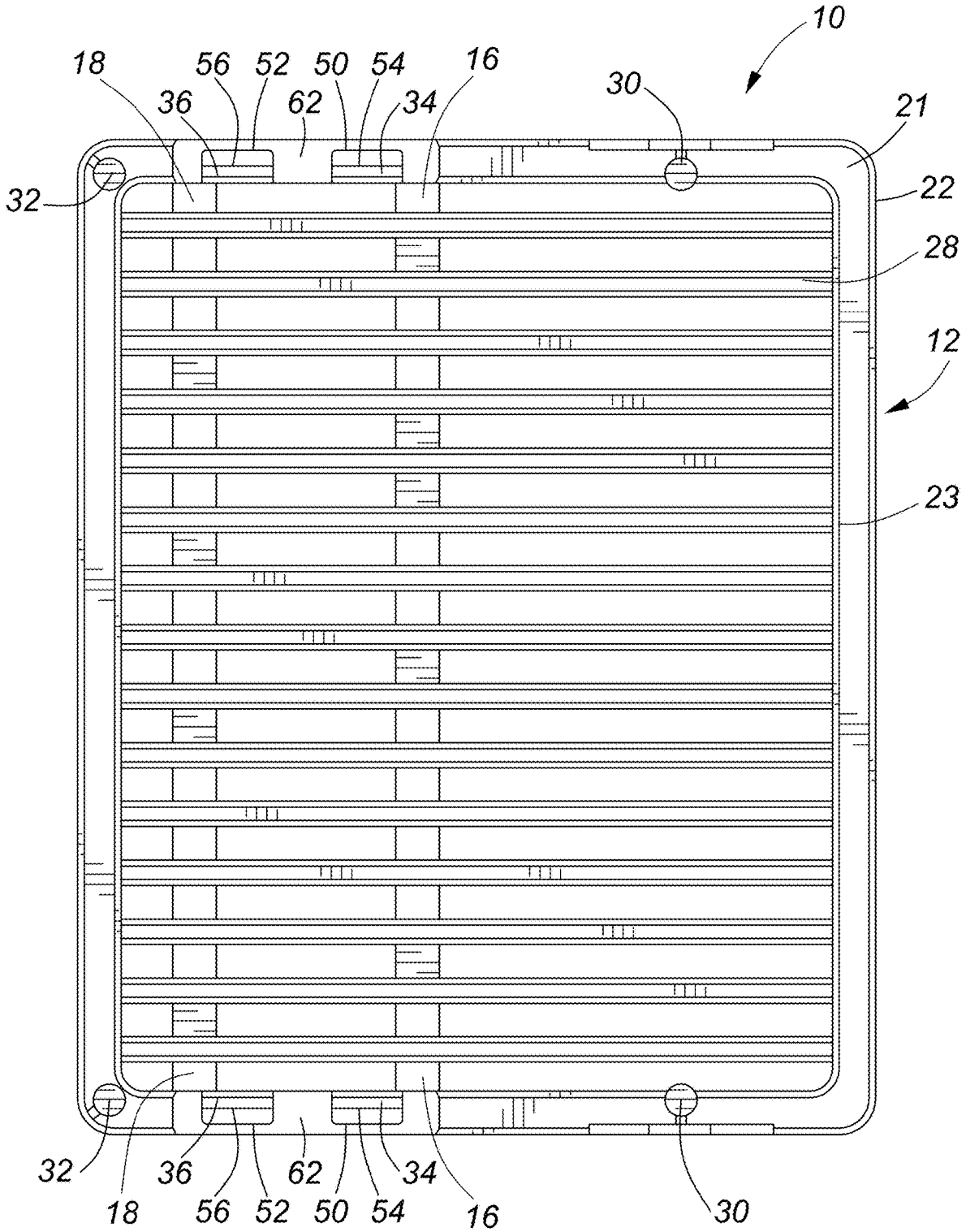
FIG. 7 is a bottom plan view of the compact drying rack in the assembled condition.

FIG. 7 is a bottom plan view of the compact drying rack 10 in the assembled condition. As explained above, the bottom end of the front arch legs 17R, 17L are provided with cantilever snap-fit connectors that include front arch protrusions 54 received in front base receptacles 50. The front arch protrusions 54 terminate in the front arch lock tabs 34. The rear arch legs 19R, 19L are provided with integral rear arch protrusions 56 received in rear base receptacles 52. The rear arch protrusions 56 terminate in the rear arch lock tabs 36. The front arch lock tabs 34 and the rear arch lock tabs 36 snap over a bottom surface of a base skirt connector 62 that unites the base perimeter outer skirt 22 and the base perimeter inner skirt 23 under the front arch legs 17R, 17L and the rear arch legs 19R, 19L. The front base receptacles 50 and rear base receptacles 52 that receive the cantilever snap-fit front arch protrusions 54 and the rear arch protrusions 56 are rectangular passages that traverse the base skirt connector 62.

Figure 8:
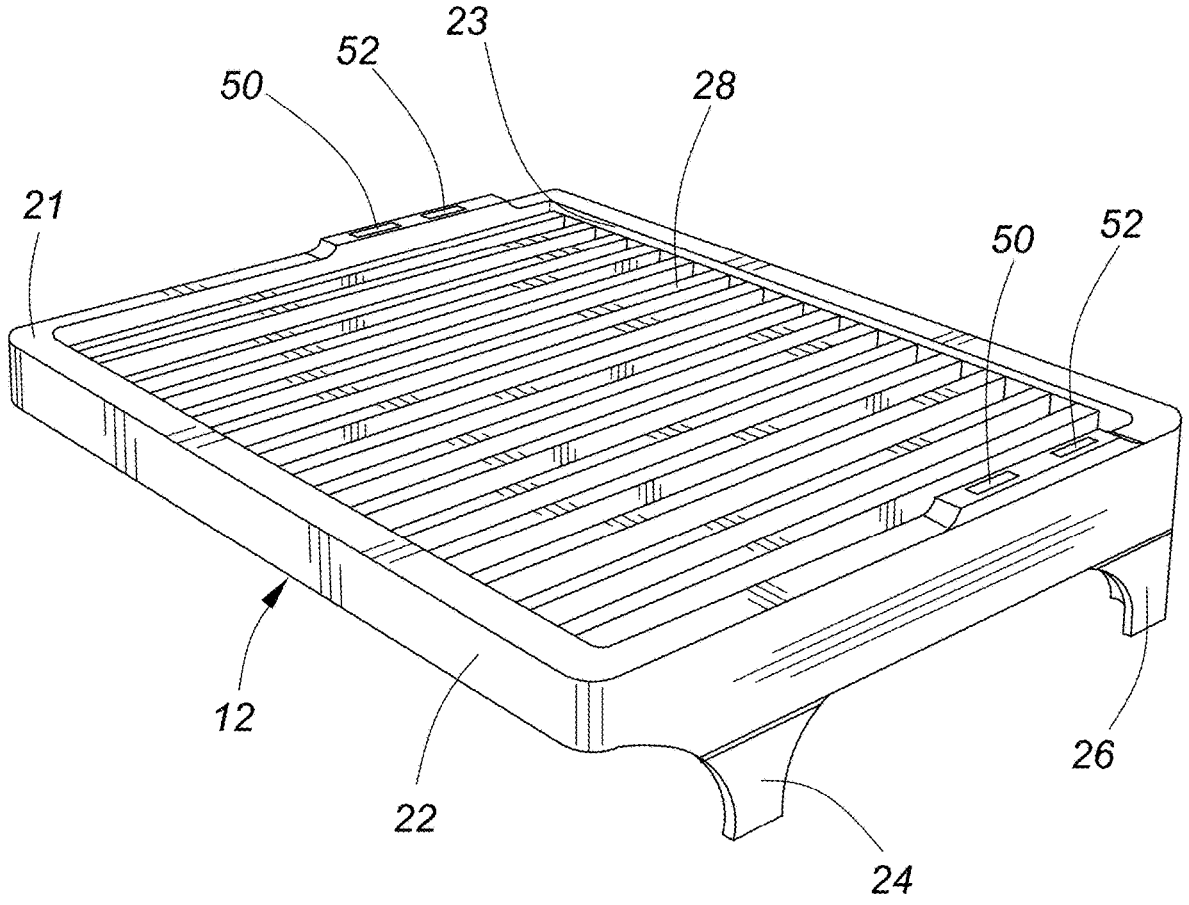
FIG. 8 is a perspective view of a base section of the compact drying rack shown in FIG. 1.

FIG. 8 is a perspective view of the rectangular base section 12 of the compact drying rack 10 shown in FIG. 1. The front base receptacles 50 receive the front arch protrusions 54 (best seen in FIG. 11) and the rear base receptacles 52 receive the rear arch protrusions 56 (best seen in FIG. 9) to removably lock the front support arch 16 and the rear support arch 18 to the rectangular base section 12.

Figure 9:
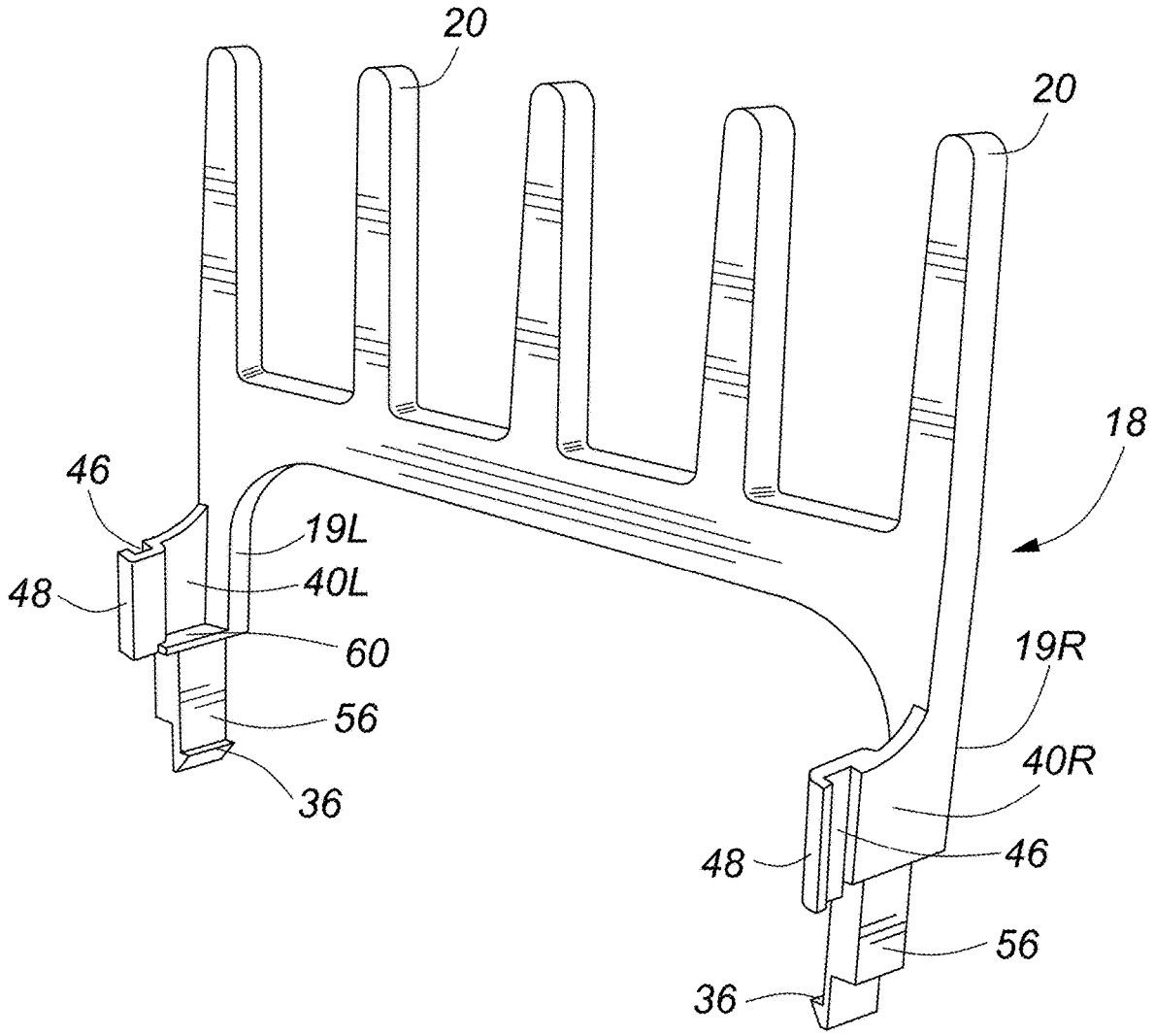
FIG. 9 is a perspective view of a rear support arch of the compact drying rack removed from the base section shown in FIG. 8.
Figure 10A:
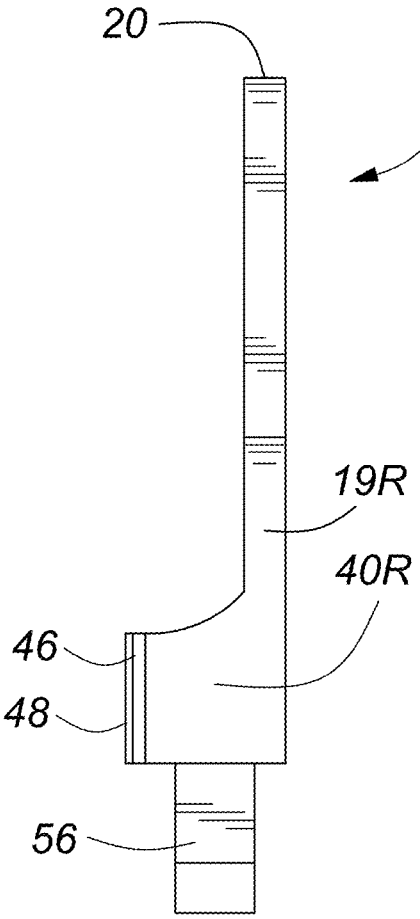
FIG. 10A is an outside elevational view of the right side of the rear support arch shown in FIG. 9.
Figure 10B:
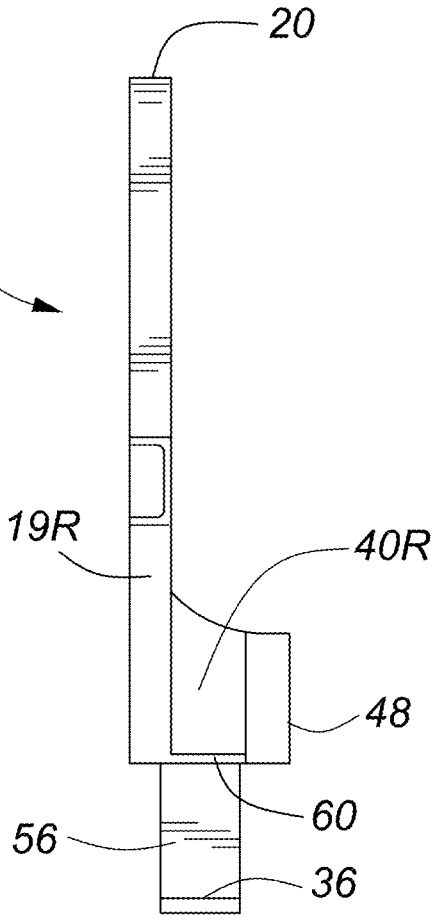
FIG. 10B is an inside elevational view of the right side of the rear support arch shown in FIG. 10A.

FIG. 9 is a perspective view of the rear support arch 18 of the compact drying rack 10 removed from the base section 12 shown in FIG. 8. FIG. 10A is an outside elevational view of the right side of the rear support arch 18 shown in FIG. 9, showing the cantilever snap-fit rear arch protrusion 56 that is an integral part of the bottom of the rear arch leg 19R and the rear arch interlock reinforcement web 60. FIG. 10B is a side elevational view of an inside of the right side of the rear support arch 18 shown in FIG. 10A.

Figure 11:
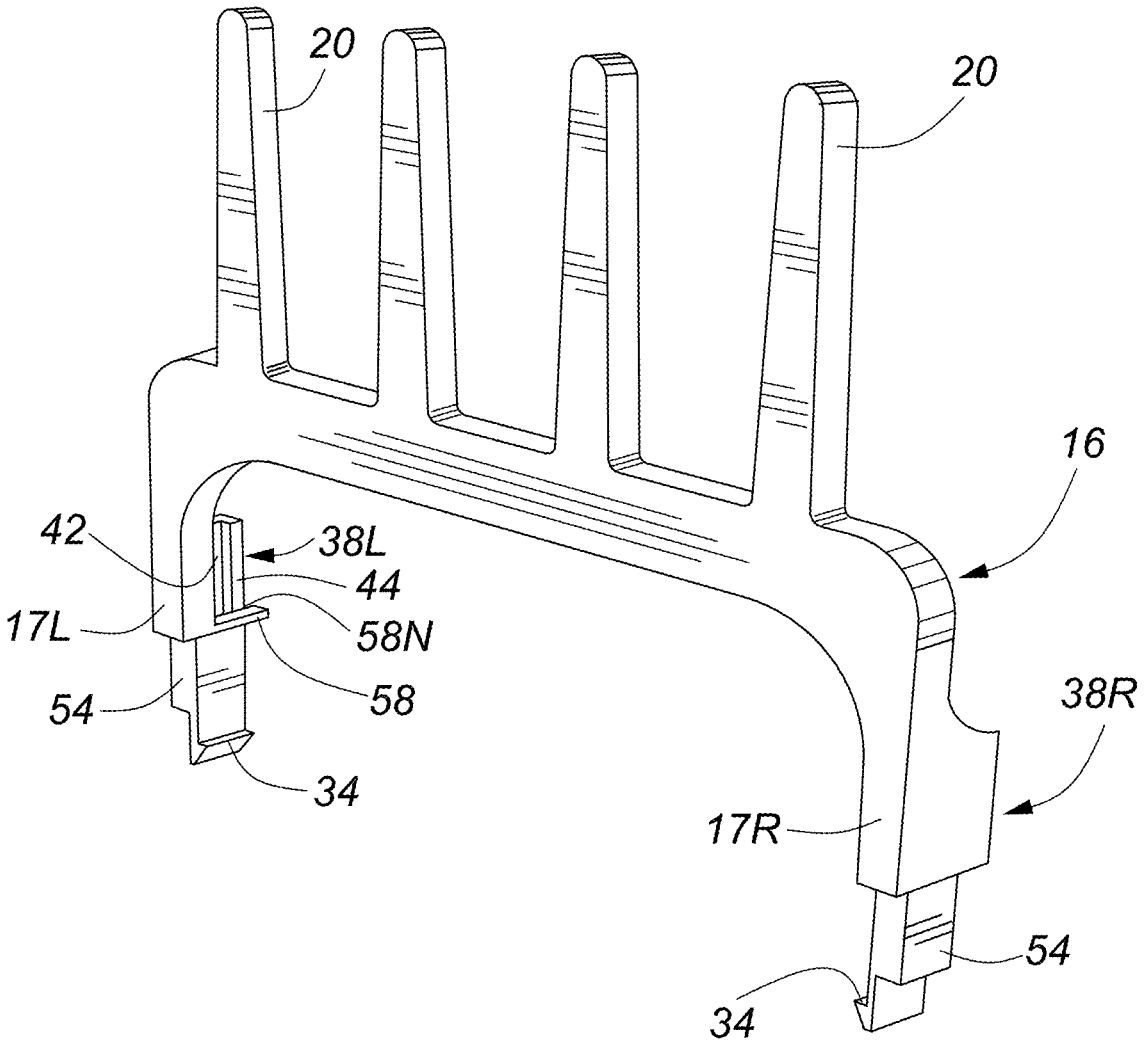
FIG. 11 is a perspective view of the front support arch of the compact drying rack removed from the base section shown in FIG. 8.
Figure 12A:
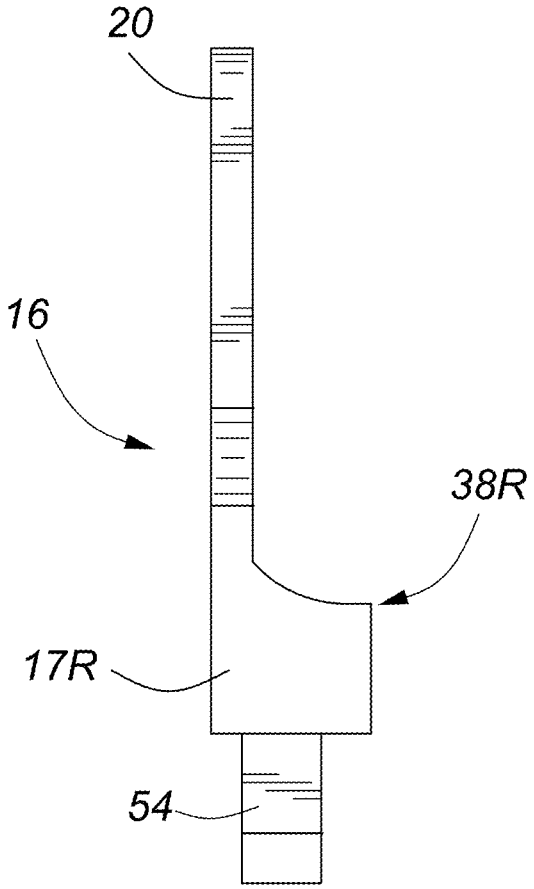
FIG. 12A is an outside elevational view of the right side of the front support arch shown in FIG. 11.
Figure 12B:
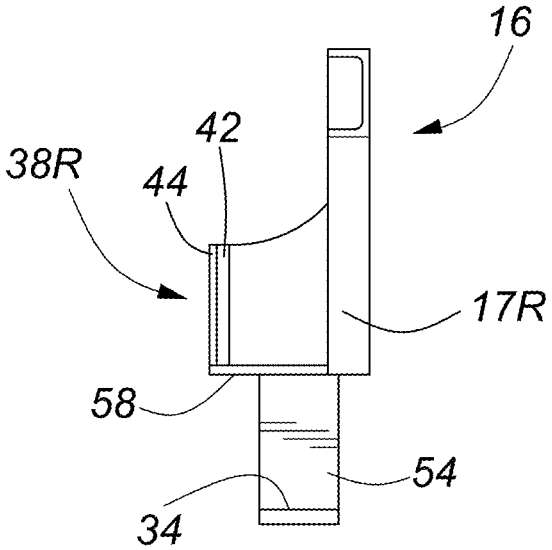
FIG. 12B is an inside elevational view of the right side of the front support arch shown in FIG. 12A.

FIG. 11 is a perspective view of the front support arch 16 of the compact drying rack 10 removed from the base section 12 shown in FIG. 8. FIG. 12A is an outside elevational view of the right side of the front support arch 16 shown in FIG. 11, showing the cantilever snap-fit front arch protrusion 54 that is an integral part of the bottom of the front arch right leg 17R and the front arch interlock reinforcement web 58 with the front arch reinforcement web notch 58N that receives the bottom end of the rear arch interlock tongue 48. FIG. 12B is a side elevational view of an inside of the right side of the front support arch 16 shown in FIG. 12A.

The compact drying rack 10 is shipped and stored with the upright support section 14 detached from the base section 12. To assemble the compact drying rack 10 the front support arch 16 and the rear support arch 18 may be connected to the compact drying base 12 in any order. For example, the front arch protrusions 54 (see FIG. 11) are inserted into the front base receptacles 50 (see FIG. 8) with the front arch interlocks 38R, 38L pointing to the rear of the base section 12. The front support arch 16 is pushed downwardly until the front arch lock tabs 34 lock over the bottom surface of the base skirt connector 62 (see FIGS. 3 and 5) and the front arch interlock reinforcement web rests on the top surface of the base skirt connector 62. After the front support arch 16 is installed, a bottom of the rear arch interlock tongue 48 (see FIG. 9) is inserted into a top of the front arch interlock groove 42 (see FIG. 11) and the rear arch protrusions 56 (see FIG. 9) are inserted into the rear base receptacles 52 (see FIG. 8) as the rear support arch 18 is pushed downward. The rear support arch 18 is then pushed downwardly until the rear arch interlock tongue 48 is inserted into the front arch interlock web groove 58N (see FIG. 11) and the rear arch interlock tongue 48 and the rear arch interlock reinforcement web 60 (see FIG. 9) rest on the top of the base skirt connector 62 and the rear arch lock tabs 36 snap over the bottom surface of the base skirt connector 62 (see FIGS. 3 and 5).

To disassemble the compact drying rack 10 for storage or shipping, the front support arch 16 and the rear support arch 18 can be removed in any order. For example, the rear arch lock tabs 36 are simultaneously pushed inwardly from the lock position while the rear arch section 18 is lifted straight upwardly while holding down the base section 12 until the rear arch lock tabs 36 are inside the rear base receptacles 52. The rear support arch 18 can then be lifted straight upwardly until it disengages the base section 12 and the front support arch 16. Then the front arch lock tabs 34 are simultaneously pushed inwardly from the lock position while the front support arch 16 is lifted straight upwardly until the front arch lock tabs 34 are inside the front base receptacles 50. The front support arch 16 can then be lifted straight upwardly until it disengages the base section 12.

The embodiment of the invention shown and described is exemplary only. The scope of the invention is therefore intended to be limited only by the scope of the claims.

I claim:

1. A compact drying rack comprising:

a substantially rectangular base section having a base perimeter top flange with a depending base perimeter outer skirt, a base perimeter inner skirt and a plurality of spaced-apart parallel base slats integral with the base perimeter inner skirt;

first and second front leg members and first and second rear leg members that support the rectangular base section above a support surface;

an upright support section removably connected to the rectangular base section, the upright support section including a front support arch having a plurality of vertical support posts and a rear support arch having a plurality of vertical support posts, the front support arch being removably connected to the rear support arch by a connection that inhibits movement of the front support arch and the rear support arch with respect to the rectangular base section when the upright support section is connected to the rectangular base section.

2. The compact drying rack as claimed in claim 1 wherein the first and second front leg members and the first and second rear leg members are integral with the depending base perimeter outer skirt.

3. The compact drying rack as claimed in claim 2 wherein the rear support legs wrap around rear corners of the rectangular base section base perimeter outer skirt.

4. The compact drying rack as claimed in claim 1 wherein the upright support section is removably connected to the rectangular base section by cantilever snap-fit connectors having front arch protrusions received in front arch receptacles in the base perimeter top flange and rear arch protrusions received in rear arch receptacles in the base perimeter top flange.

5. The compact drying rack as claimed in claim 4 wherein the front support arch and the rear support arc are removably interconnected by a double tongue and groove connection provided by front arch interlocks and rear arch interlocks.

6. The compact drying rack as claimed in claim 5 wherein the double tongue and groove connection comprises a front arch interlock groove slidably engaged by a rear arch interlock tongue that forms a rear arch interlock groove slidably engaged by a front arch interlock tongue.

7. A compact drying rack comprising:

a substantially rectangular base section having a base perimeter top flange with a depending base perimeter outer skirt, a base perimeter inner skirt and a plurality of spaced-apart parallel base slats integral with the base perimeter inner skirt;

first and second front leg members and first and second rear leg members that support the rectangular base section above a support surface;

an upright support section removably connected to the rectangular base section by cantilever snap-fit connectors, the upright support section including a front support arch having a plurality of spaced-apart vertical support posts and a rear support arch having a plurality of spaced-apart vertical support posts, the front support arch being removably connected to the rear support arch by sliding engagement of a double tongue and groove connection that inhibits movement of the front support arch and the rear support arch with respect to the rectangular base section when the upright support section is connected to the rectangular base section by the respective cantilever snap-fit connectors.

8. The compact drying rack as claimed in claim 7 wherein the first and second front leg members and the first and second rear leg members are integral with the depending base perimeter outer skirt.

9. The compact drying rack as claimed in claim 8 wherein the rear support legs wrap around rear corners of the rectangular base section base perimeter outer skirt.

10. The compact drying rack as claimed in claim 7 wherein the cantilever snap-fit connectors have front arch protrusions received in front arch receptacles in the base perimeter top flange and rear arch protrusions received in rear arch receptacles in the base perimeter top flange.

11. The compact drying rack as claimed in claim 7 wherein the double tongue and groove connection comprises a front arch interlock tongue adjacent a front arch interlock groove that is slidably engaged by a rear arch interlock tongue that forms a rear arch interlock groove that is slidably engaged by the front arch interlock tongue.

12. A compact drying rack comprising:

a substantially rectangular base section having a base perimeter top flange with a depending base perimeter outer skirt, a base perimeter inner skirt and a plurality of spaced-apart parallel base slats integral with the base perimeter inner skirt, the base perimeter top flange including front base receptacles and rear base receptacles adjacent a rear edge of the rectangular base section;

first and second front leg members and first and second rear leg members that support the rectangular base section above a support surface;

an upright support section removably connected to the rectangular base section by cantilever snap-fit connectors having front arch protrusions received in the front base receptacles and rear arch protrusions received in the rear base receptacles, the upright support section including a front support arch having a plurality of spaced-apart vertical support posts and a rear support arch having a plurality of spaced-apart vertical support posts, the front support arch being removably connected to the rear support arch by sliding engagement of a double tongue and groove connection that inhibits movement of the front support arch and the rear support arch with respect to the rectangular base section when the upright support section is connected to the rectangular base section by the cantilever snap-fit connectors;

the double tongue and groove connection including a rear arch interlock tongue slidably received in a front arch interlock groove, the rear arch interlock tongue providing a rear arch interlock groove that slidably receives a front arch interlock tongue adjacent the front arch interlock groove.

* * * * *